US006867739B2

(12) United States Patent
Prassmayer et al.

(10) Patent No.: US 6,867,739 B2
(45) Date of Patent: Mar. 15, 2005

(54) DIVERSITY-ANTENNA SYSTEM FOR MOVING VEHICLES

(75) Inventors: Peter Karl Prassmayer, Grosskarolinenfeld (DE); Florian Haidacher, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/470,489

(22) PCT Filed: Mar. 6, 2003

(86) PCT No.: PCT/EP03/02310

§ 371 (c)(1),
(2), (4) Date: Oct. 16, 2003

(87) PCT Pub. No.: WO03/077362

PCT Pub. Date: Sep. 18, 2003

(65) Prior Publication Data

US 2004/0070544 A1 Apr. 15, 2004

(30) Foreign Application Priority Data

Mar. 14, 2002 (DE) ..... 102 11 341

(51) Int. Cl.[7] ..... H01Q 1/32
(52) U.S. Cl. ..... 343/713; 343/704
(58) Field of Search ..... 343/713, 704, 343/711, 712, 850; H01Q 1/32

(56) References Cited

U.S. PATENT DOCUMENTS

| | | | | |
|---|---|---|---|---|
| 5,905,469 | A | 5/1999 | Lindenmeier et al. | |
| 6,243,043 | B1 * | 6/2001 | Terashima et al. | 343/713 |
| 6,603,435 | B2 * | 8/2003 | Lindenmeier et al. | 343/713 |

FOREIGN PATENT DOCUMENTS

| | | | |
|---|---|---|---|
| DE | 20 36 809 | C2 | 1/1983 |
| DE | 37 19 692 | C2 | 9/1991 |
| DE | 43 21 805 | A1 | 1/1994 |
| DE | 100 33 336 | A1 | 4/2001 |
| EP | 0 506 334 | A1 | 9/1992 |
| EP | 0 792 031 | A2 | 8/1997 |
| EP | 1 021 000 | A2 | 7/2000 |

OTHER PUBLICATIONS

Lindenmeier et al; "Diversity–Effizienz Geschalteter Antennenstrukturen in Kraftfahrzeugen"; Institut fur Hoch–und Hochstfrequenztechnik; Universitat der Bundeswehr Munchen, Neubiberg, FRG.

* cited by examiner

*Primary Examiner*—Hoanganh Le
(74) *Attorney, Agent, or Firm*—Nixon & Vanderhye P.C.

(57) ABSTRACT

An improved diversity antenna system for moving vehicles is distinguished, inter alia, by the following features:

Figure 1:
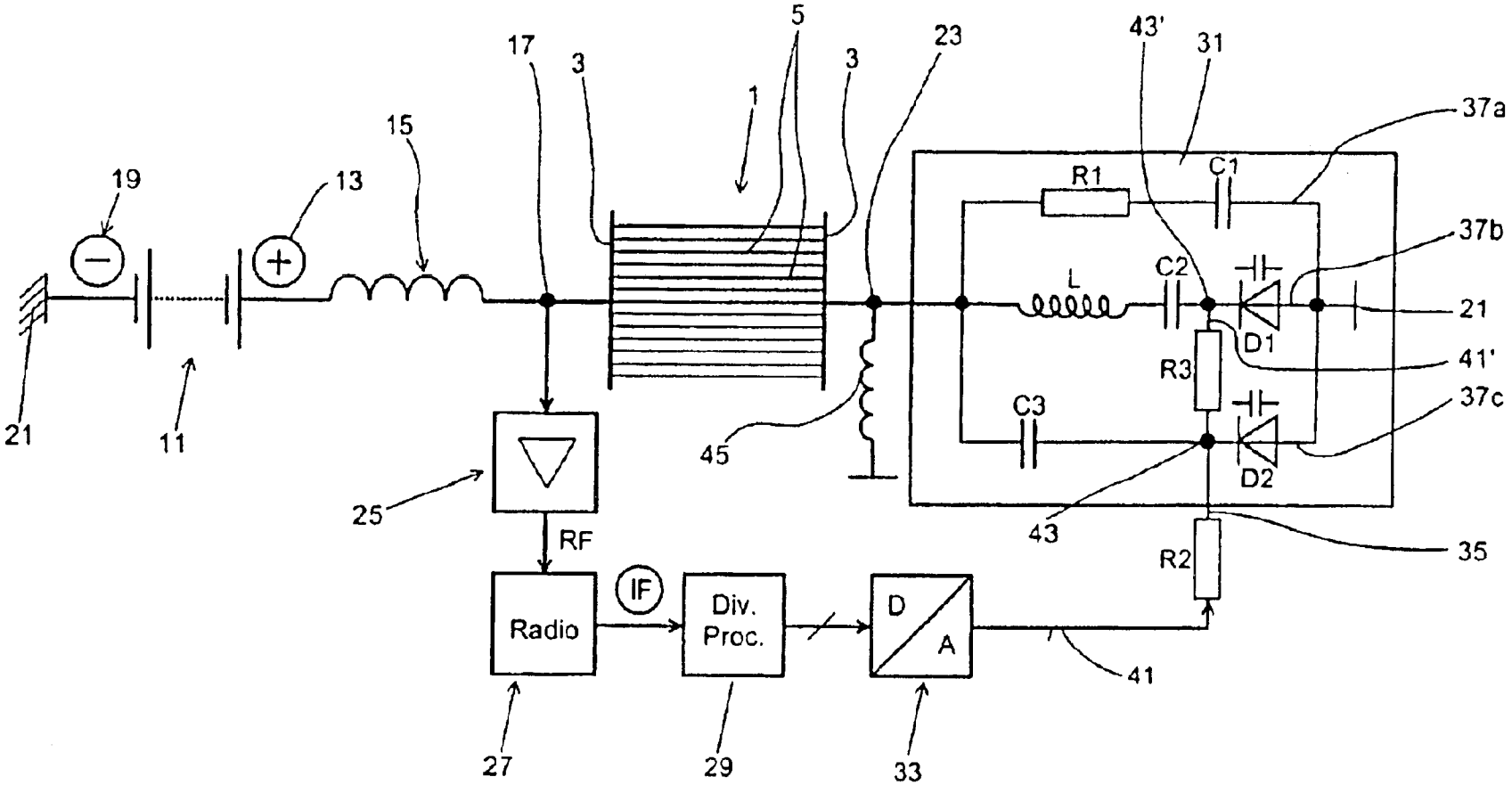

the diversity antenna system can be retrofitted, the first antenna connection (17') is formed by the first heating connection (17), the first heating line (17*a*) and/or the first busbar (3) of the heating panel (1), the second antenna connection (23') is formed by the second heating connection (23), the second heating connecting line (23*a*) and/or the second busbar (3') of the heating panel (1), the device for producing different terminating impedances or reactances of different magnitude comprises a tuning box (31), and the tuning box (31) has one or more circuits, via which the magnitude of the terminating impedances or reactances which are formed in the tuning box can be varied continuously or in analog form or a switching box (31') is provided, having at least three integrated different terminating impedances or reactances.

10 Claims, 2 Drawing Sheets

DIVERSITY-ANTENNA SYSTEM FOR MOVING VEHICLES

This application is a 371 of PCT/EP03/02310 filed Mar. 6, 2003.

Diversity antenna systems are used for improving the reception quality in vehicles.

A subdivided heating panel which is accommodated in the rear windshield of an automobile, possibly as well as two further antenna systems, which are fitted in the front windshield of an automobile or at some other point, are frequently used in this case, and are supplemented to form what is referred to as an antenna diversity system. The received signal is evaluated permanently and in discrete steps in order to switch to a different antenna in each case when a deterioration is found. The aim of this is to ensure the best-possible reception.

A scanning antenna system for vehicles has been disclosed, for example, in EP 1 021 000 A2. According to this prior publication, an antenna system for vehicles having a multiple antenna system and having at least two antennas is disclosed as being known, from whose received voltage at least two antenna signals are formed. These signals are supplied to a logic switching device, by means of which a switching signal, which differs for diversity purposes, can in each case be passed to the receiver using different switching positions. This switching signal drives a diversity processor with an IF signal that is derived from the received signal, and the diversity processor quickly switches the logic switching device to a different switching position when the reception is subject to interference.

Furthermore, a diversity antenna system has also been disclosed in EP 0 792 031 A2. This already known antenna system likewise has a controllable switching device and a receiver which is connected via an antenna line. An interference detector is provided in the receiver and, when reception interference occurs in the received signal or in the IF signal, indicates this by means of an indication signal. The antenna system with the controllable switching device has two or more individual antennas or antenna parts. Furthermore, a common antenna connecting point is provided, to which the receiver is connected via one antenna line. When interference occurs, it is then possible to switch from one antenna to another antenna in each case, via a changeover switch.

According to this publication, a heating panel in a motor vehicle is preferably used as an antenna device, to be precise preferably as a subdivided antenna array. In one exemplary embodiment, the two halves of the heating panel, which is integrated in the rear windshield, are in this case connected on the output side to a respective amplifier, with the two amplifiers then being connected, on the basis of one switching device, to a connecting line which leads to the radio receiver. In addition, a large number of further antenna connecting points are provided, at which corresponding antenna received signals can be tapped off in order to achieve a diversity system which is as comprehensive as possible.

In principle, it is known from both EP 0 792 031 A2, which has been explained, and, for example, from DE 20 36 809 C2, that it is possible to vary the polar diagram characteristics of the conductor arrays which are formed as antennas, by connection of the individual antenna connecting points and/or the conductor or the conductor combination to reactances.

In this case, DE 20 36 809 C2 deals with the problem of single-knob tuning, since in this case very accurate synchronization is required between the antenna tuning on the one hand and the setting of the oscillator frequency of the converter on the other hand. One disadvantage that has been found in this case is that, when tuning such as this is carried out, the physical separation of the tuning reactances in the antenna and receiver results in different environmental loads on these reactances, in particular different temperatures, which make synchronization very difficult and generally entirely impossible. In order to solve the problem, it is therefore proposed that a mixing stage with an oscillator be connected to the output of the amplifier without a lengthy intermediate line, with the circuit that governs the frequency of the oscillator having a second electronic reactance, whose impedance can be varied by means of a DC voltage.

According to EP 0 792 031 A2, which has been mentioned, and in contrast to a heating panel which is integrated in a rear windshield, impedances preferably in the form of reactances are connected to two or more antenna connecting points, to be precise using switches which are provided in series for this purpose and which can be driven via a switching device. This means that the antenna signal can in each case be tapped off via a different connecting point on the heating panel via the diversity processor when interference occurs. One exemplary embodiment furthermore discloses controllable changeover switches being provided as well at one of the two or more antenna element connections, in order to connect different reactances to an antenna connection associated with them, as required, and in order in this way to vary the directional characteristic of the antenna.

However, all of these solutions are always solutions which are prepared and adapted appropriately by the manufacturer, in order to make it possible to tap off the various reactances at the different antenna connecting points as required, in order to receive a transmitter signal which is subject to as little interference as possible.

A diversity antenna for a diversity antenna system in a vehicle has also been disclosed in DE 100 33 336 A1. According to this prior publication, a large number of different exemplary embodiments of such a diversity antenna system are described, with a heating panel which may have one or more sections that can be driven electrically separately always being used as an antenna. The heating panel is in this case normally provided with two busbars, which are each connected to one heating line. In addition, the heating panels have separate antenna connections to which, for example, a radio can be connected. In [sic] impedance network and a switching device are then, for example, connected to the second antenna connection, with the aim of in this way ensuring that, when reception interference occurs in the antenna signal, switching of the impedance value of at least one electronically controllable impedance network results in an antenna signal, which is different for diversity purposes, at the output of the connecting network. To achieve this, two switching diodes are used in the impedance network, thus making it possible to generate four different reactances.

In contrast, the object of the present invention is to provide an improved diversity antenna system, whose design is very simple and by means of which, even when interference occurs, appropriate switching can be carried out to receive a better antenna signal, with the further aim that this antenna system can also be retrofitted.

According to the invention, the object is achieved according to the features specified in claim 1 or 7. Advantageous refinements of the invention are specified in the dependent claims.

The invention is based on a single active antenna, which is preferably formed by the heating lines for a heated window in a vehicle. An amplifier is connected at least indirectly to the antenna connecting point for this purpose. The actual reception box for the radio can be provided physically separately from this. The amplifier may, of course, itself also be integrated in the radio. As is known, corresponding evaluation of the quality of the received antenna signal is also carried out via a diversity processor.

A heating panel, for example on a rear windshield of a vehicle, normally has two busbars, with a heating line leading to each of them, and which are thus connected to a heating connection. The electrical power connection for heating the heating panel is provided via this connection. In order to provide a retrofitting capability according to the invention, no separate antenna connections are now required originally on the heating panel or on the busbars, with provision instead being made for the connection to be made via the two heating connections and the two heating lines or the two busbars. Thus, in other words, the system according to the invention can be retrofitted, since no additional tapping points are required on the heating panel, on the busbars etc.; and, instead, the two existing heating lines or heating connections which lead from the busbars or from the heating panel can be used as required.

According to the invention, provision is now made for a tuning and/or switching box to be connected to a second antenna connecting point. The reactances are varied via this tuning box, either in an analog form or in discrete individual steps by switching, such that it is always possible to receive an optimum antenna signal.

In the case of a tuning box, an analog signal (that is to say a tuning voltage) is first of all produced via the diversity processor and via a digital/analog converter, and is then supplied to the tuning box. This is used to vary the reactance appropriately, by which means the directional characteristic of the antenna device formed by the heating panel can be varied appropriately.

If a switching box is used, then it is possible to switch between different reactances via the diversity processor.

Thus, according to the invention, a connection with the heating panel is made only at two connecting points, namely with the radio being connected at least indirectly to one connecting point while, in contrast, a tuning or switching box is connected to the second connecting point, and is driven at least indirectly via the diversity processor in order to vary the directional characteristic of the antenna.

The major advantage of this circuit arrangement is that the entire arrangement is extremely simple, and that only one amplifier is required for it, that, furthermore, no special heating conductor antenna elements with additional connecting points are required, and that, as a result of this, an already existing heating panel, with its two connecting points for the positive pole or negative pole, can be used as a connecting point for the diversity antenna system, which can be retrofitted.

Figure 2:
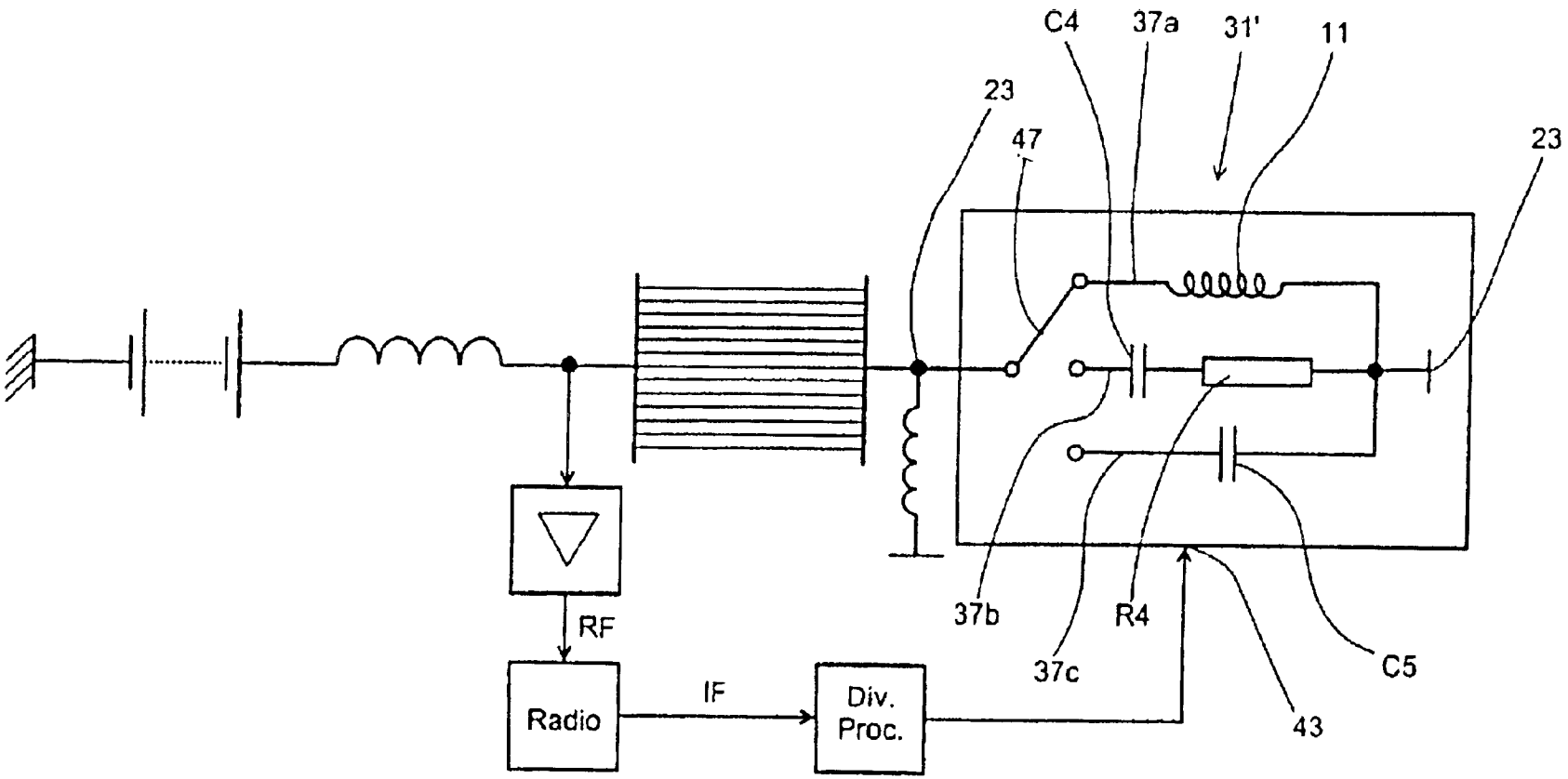

The invention will be explained in more detail in the following text with reference to exemplary embodiments in which, in detail:

FIG. 1: shows a first exemplary embodiment of a diversity antenna system with a tuning box, and FIG. 2: shows a diversity antenna system with a switching box.

FIG. 1 shows, schematically, a heating panel 1 which is formed from two opposite busbars 3 and a large number of heating wires 5 which run between them and are generally parallel. Heating panels 1 such as these are generally accommodated in the rear windshields of vehicles. The wires are in this case embedded in the glass or are printed on the glass.

A heating panel 1 such as this acts [sic] at the same time also used as a window pane antenna 7, referred to for short in the following text as an antenna 7, as well.

The heating panel 1 is connected in a known manner to a motor vehicle rechargeable battery 11, with, for example, the positive pole 13 of the rechargeable battery being connected via an inductor 15 to a first connection 17 of the heating panel 1, which forms a connection to one busbar 3. The negative pole 19 is normally in the end electrically connected via ground 21 to the second connection 23, which represents the connection to the second busbar 3.

In order now to retrofit a diversity antenna system, the input side of an amplifier 25 is, according to the invention, connected at least indirectly to the first connection 17 of the heating panel 1 or of the antenna 7, with the output side of the amplifier 25 being connected to the actual receiving section or radio 27.

The radio produces an IF signal, which can be evaluated in a downstream diversity processor 29. In the exemplary embodiment shown in FIG. 1, a tuning box 31, which is driven in an analog manner, is now used to provide a diversity antenna system. For this purpose, the output of the diversity processor 29 is connected to the input of a digital/analog converter 33, whose output is connected to one input 35 of the tuning box 31.

Suitable tuning circuits can now be provided in the tuning box, in order to vary the reactance on the connection side and hence to provide a different load on the foot point of the antenna. This varies the directional characteristic of the heating panel 1 which is used as the antenna 7.

In the illustrated exemplary embodiment, the tuning box has three parallel-connected branches 37*a* to 37*c* for this purpose, which in the end are connected between the second connection 23 and at least indirectly to the second pole 19 or to ground 21. For this purpose, a resistor R1 and a capacitor C1 are connected in series in the first branch 37*a*, a coil L, a capacitor C2 and a capacitance diode D1 are connected in series in the second branch 37*b*, and a capacitor C3 with a capacitance diode D1 are connected in series in the third branch 37*c*.

The control line 41 which is connected to the digital/analog converter 33 passes via a resistor R2 to a connecting point 43 between the capacitor C3 and the capacitance diode D2 in the third branch 37*c*, in which case the control line 41 can be continued or lengthened via a resistor R3 to a second connecting point 43', which is connected in the second branch 37*b* between the capacitor C2 and the capacitance diode D1.

Furthermore, a coil 45 must also be connected between ground (the negative pole) and the second connection 23, in order to carry the heating panel current away.

If the diversity processor detects any deterioration in the transmitter signal, then the reactances can be varied appropriately until an improved input signal is once again received at the antenna. In this case, it is even possible to store a priority list in a memory device (for example in the radio or in the diversity processor), which is used to define the direction in which and/or the values to which the reactances are in each case changed initially, by means of an appropriate drive to the tuning box.

Thus, depending on the design and/or the tuning voltage, any desired terminating impedances can thus be set within a specific frequency range in the tuning box (variable susceptance).

The exemplary embodiment shown in FIG. 2 largely corresponds to that shown in FIG. 1, and differs essentially in that a switching box 31' is used rather than a tuning box 31 which can be driven continuously, that is to say in an analog form. There is therefore no need for a digital/analog converter 33 in the exemplary embodiment shown in FIG. 2, either, since, in this case, the switching box 31' can be driven appropriately directly from the diversity processor 29.

The switching box is likewise once again connected between the ground connection 23 or the negative pole 19 and the second antenna connection 23, and has a control input 43, via which the corresponding switching signals from the diversity processor 29 are received.

The switching box 31' likewise once again has three branches 37*a* to 37*c*, namely a first branch 37*a* with an inductance 11, a second branch 37*b* connected in parallel with it and having capacitance C4 and a resistor R4 connected in series with it, and a third branch 37*c* with a capacitance C5. While all three branches are connected to one another on the ground side, a changeover switch 47 is provided on the antenna array side, and is driven appropriately via the diversity processor. In consequence, in the event of interference with reception, switching can be carried out in discrete steps in the switching box in order in this way once again to vary the reactances and, via them, to vary the directional characteristic of the antenna once again.

The tuning box 31 as shown in FIG. 1 and the switching box 31' as shown in FIG. 2 are only illustrative examples. The design of this tuning or switching box 31, 31' may also differ, to be precise also having even more branches, if required.

What is claimed is:

1. A diversity antenna system for vehicles which have a heating panel (1) which is used as an antenna, with the heating panel (1) having two heating connections (17, 23) and/or two heating connecting lines (17*a*, 23*a*) as well as two antenna connections (17', 23'), having the following features:

an amplifier (25) is or can be connected to the first antenna connection (17') and is or can be electrically connected on the output side to a receiving section or radio (27), a diversity processor (29) is provided, which preferably evaluates an IF signal from the receiving section or radio (27), the first antenna connection (17') and/or the amplifier (25) and/or the receiving section or the radio (27) are/is connected to the diversity processor (29), and a device for producing different terminating impedances or reactances of different magnitude is connected to the second antenna connection (23') and is operated in particular at least indirectly via the diversity processor (29), characterized by the following further features:

the diversity antenna system can be retrofitted, the first antenna connection (17') is formed by the first heating connection (17), the first heating line (17*a*) and/or the first busbar (3) of the heating panel (1), the second antenna connection (23') is formed by the second heating connection (23), the second heating connecting line (23*a*) and/or the second busbar (3') of the heating panel (1), the device for producing different terminating impedances or reactances of different magnitude comprises a tuning box (31), and the tuning box (31) has one or more circuits, via which the magnitude of the terminating impedances or reactances which are formed in the tuning box can be varied continuously or in analog form.

2. The diversity antenna system as claimed in claim 1, characterized in that the device for producing terminating impedances of different magnitude or reactances of different magnitude also includes the diversity processor (29).

3. The diversity antenna system as claimed in claim 1, characterized in that the diversity processor (29) is connected at least indirectly to a digital/analog converter (33), whose output is connected via a tuning line (43) to a control output of the tuning box (31) for analog variation of the terminating impedances or of the reactances.

4. The diversity antenna system as claimed claim 1, characterized in that the circuits or branches (37*a* to 37*c*) which are provided in the tuning box (31) comprise at least one series-connected resistor R1 and a capacitance (C1), or a coil (L), a capacitance (C2) and a capacitance diode (D1), or a capacitance (C3) and a capacitance diode (D2).

5. The diversity antenna system as claimed in claim 4, characterized in that the tuning line (41) coming from the dialog [sic]/analog converter (33) is connected to one diode connection side directly or with the interposition of an intermediate line (41') for tuning the capacitance diodes (D1, D2) which are provided in the branches or circuits (37*a* to 37*c*).

6. The diversity antenna system as claimed in claim 1, characterized in that the tuning box (31) has capacitance diodes (D1, D2) for continuous variation of the terminating impedances or reactances.

7. A diversity antenna system for vehicles which have a heating panel (1) which is used as an antenna, with the heating panel (1) having two heating connections (17, 23) and/or two heating connecting lines (17*a*, 23*a*) as well as two antenna connections (17', 23'), having the following features:

an amplifier (25) is or can be connected to the first antenna connection (17') and is or can be electrically connected on the output side to a receiving section or radio (27), a diversity processor (29) is provided, which preferably evaluates an IF signal from the receiving section or radio (27), the first antenna connection (17') and/or the amplifier (25) and/or the receiving section or the radio (27) are/is connected to the diversity processor (29), and a device for producing different terminating impedances or reactances of different magnitude is connected to the second antenna connection (23') and is operated in particular at least indirectly via the diversity processor (29), characterized by the following further features:

the diversity antenna system can be retrofitted, the first antenna connection (17') is formed by the first heating connection (17), the first heating line (17*a*) and/or the first busbar (3) of the heating panel (1), the second antenna connection (23') is formed by the second heating connection (23), the second heating connecting line (23*a*) and/or the second busbar (3') of the heating panel (1), the device for producing different terminating impedances or reactances of different magnitude comprises a switching box (31') having at least three integrated circuits which produce different terminating impedances or reactances.

8. The diversity antenna system as claimed in claim 7, characterized in that the at least three circuits (37*a* to 37*c*) are at least indirectly connected on one of their sides to one pole (19) of a rechargeable battery (11) while, in contrast, the other end of the branches or circuits (37*a* to 37*c*) can be connected via a changeover switch (47) to the second connection (23) of the heating panel (1) or of the antenna.

9. The diversity antenna system as claimed in claim 7, characterized in that the various branches or circuits (37*a* to 37*c*) preferably comprise an inductance (11), or a series-connected capacitance (C4) and a resistor (R4), or a capacitance (C5).

10. The diversity antenna system as claimed in claim 7, characterized in that the device for producing terminating impedances of different magnitude or reactances of different magnitude also includes the diversity processor (29).

* * * * *